US011319776B2

(12) United States Patent
Saraya

(10) Patent No.: US 11,319,776 B2
(45) Date of Patent: May 3, 2022

(54) METHODS AND SYSTEMS FOR A PIN POINT FRAC SLEEVES SYSTEM

(71) Applicant: Vertice Oil Tools, Missouri City, TX (US)

(72) Inventor: Mohamed Ibrahim Saraya, Sugarland, TX (US)

(73) Assignee: Vertice Oil Tools Inc., Stafford, TX (US)

( * ) Notice: Subject to any disclaimer, the term of this patent is extended or adjusted under 35 U.S.C. 154(b) by 149 days.

(21) Appl. No.: 16/279,327

(22) Filed: Feb. 19, 2019

(65) Prior Publication Data

US 2019/0178053 A1 Jun. 13, 2019

Related U.S. Application Data

(63) Continuation of application No. 15/191,440, filed on Jun. 23, 2016, now Pat. No. 10,260,314.

(51) Int. Cl.

| | |
|---|---|
| ***E21B 34/14*** | (2006.01) |
| ***E21B 43/26*** | (2006.01) |
| ***E21B 34/06*** | (2006.01) |
| ***E21B 34/10*** | (2006.01) |
| ***E21B 43/14*** | (2006.01) |

(52) U.S. Cl.

CPC ..... *E21B 34/142* (2020.05); *E21B 34/063* (2013.01); *E21B 34/10* (2013.01); *E21B 34/102* (2013.01); *E21B 43/14* (2013.01); *E21B 43/26* (2013.01); *E21B 2200/06* (2020.05)

(58) Field of Classification Search

CPC ..... E21B 43/26; E21B 34/14; E21B 34/142; E21B 2200/06

See application file for complete search history.

(56) References Cited

U.S. PATENT DOCUMENTS

| | | | | |
|---|---|---|---|---|
| 4,406,335 | A * | 9/1983 | Koot | E21B 34/14 166/318 |
| 4,574,894 | A * | 3/1986 | Jadwin | E21B 21/103 175/317 |
| 4,945,995 | A * | 8/1990 | Tholance | E21B 34/102 166/375 |
| 5,012,871 | A * | 5/1991 | Pleasants | E21B 23/02 166/386 |
| 6,065,535 | A * | 5/2000 | Ross | E21B 43/04 166/51 |
| 6,253,861 | B1 * | 7/2001 | Carmichael | E21B 21/103 175/237 |
| 7,934,559 | B2 * | 5/2011 | Posevina | E21B 21/103 166/318 |
| 8,272,445 | B2 * | 9/2012 | Fay | F16K 3/26 166/373 |
| 9,328,579 | B2 * | 5/2016 | Wilson | E21B 21/103 |
| 9,382,769 | B2 * | 7/2016 | Wilson | E21B 21/103 |

(Continued)

FOREIGN PATENT DOCUMENTS

| | | | | |
|---|---|---|---|---|
| WO | WO-2015039698 | A1 * | 3/2015 | E21B 34/14 |

OTHER PUBLICATIONS

"Independent." Merriam-Webster.com. 2021. https://www.merriam-webster.com/dictionary/independent (Apr. 29, 2021) (Year: 2021).*

*Primary Examiner* — Robert E Fuller

(74) *Attorney, Agent, or Firm* — Pierson IP, PLLC

(57) ABSTRACT

A frac sleeve with a set of inner sleeves that allow selective opening and closing of such sleeves.

19 Claims, 20 Drawing Sheets

(56) References Cited

U.S. PATENT DOCUMENTS

| | | | | |
|---|---|---|---|---|
| 2005/0061508 | A1* | 3/2005 | Surjaatmadja | E21B 43/26 166/306 |
| 2012/0012322 | A1* | 1/2012 | Korkmaz | E21B 34/14 166/308.1 |
| 2013/0048290 | A1* | 2/2013 | Howell | E21B 41/00 166/305.1 |
| 2013/0168090 | A1* | 7/2013 | Themig | E21B 43/14 166/285 |
| 2013/0319767 | A1* | 12/2013 | Wilson | E21B 47/26 175/24 |
| 2015/0041133 | A1* | 2/2015 | Chauffe | E21B 43/14 166/284 |
| 2015/0053408 | A1* | 2/2015 | Purkis | E21B 43/14 166/308.1 |

* cited by examiner

FIG. 17

1700

| 1710 | 1720 | 1740 / 1730 |
|---|---|---|
| Stage 1 | Sleeve 1 | BIGGEST |
| | | BIG |
| | Sleeve 2 | BIGGEST |
| | | BIG |
| | Sleeve 3 | BIGGEST |
| | | BIG |
| | Sleeve 4 | BIGGEST |
| | | BIG |
| | Sleeve 5 | BIGGEST |
| | | BIG |
| Stage 2 | Sleeve 6 | BIG |
| | | NORMAL |
| | Sleeve 7 | BIG |
| | | NORMAL |
| | Sleeve 8 | BIG |
| | | NORMAL |
| | Sleeve 9 | BIG |
| | | NORMAL |
| | Sleeve 10 | BIG |
| | | NORMAL |
| Stage 3 | Sleeve 11 | NORMAL |
| | | SMALL |
| | Sleeve 12 | NORMAL |
| | | SMALL |
| | Sleeve 13 | NORMAL |
| | | SMALL |
| | Sleeve 14 | NORMAL |
| | | SMALL |
| | Sleeve 15 | NORMAL |
| | | SMALL |

FIG. 18

| | | |
|---|---|---|
| Stage 1 | Sleeve 1 | biggest |
| | | Big |
| | Sleeve 2 | biggest |
| | | Big |
| | Sleeve 3 | biggest |
| | | Big |
| | Sleeve 4 | biggest |
| | | Big |
| | Sleeve 5 | biggest |
| | | Big |
| Stage 2 | Sleeve 6 | Normal |
| | | Below Normal |
| | Sleeve 7 | Normal |
| | | Below Normal |
| | Sleeve 8 | Normal |
| | | Below Normal |
| | Sleeve 9 | Normal |
| | | Below Normal |
| | Sleeve 10 | Normal |
| | | Below Normal |
| Stage 3 | Sleeve 11 | Small |
| | | Smallest |
| | Sleeve 12 | Small |
| | | Smallest |
| | Sleeve 13 | Small |
| | | Smallest |
| | Sleeve 14 | Small |
| | | Smallest |
| | Sleeve 15 | Small |
| | | Smallest |

FIG. 19

| | | |
|---|---|---|
| Stage 1 | Sleeve 1 | Biggest |
| | | Small |
| | Sleeve 2 | Biggest |
| | | Small |
| | Sleeve 3 | Biggest |
| | | Small |
| | Sleeve 4 | Biggest |
| | | Small |
| | Sleeve 5 | Biggest |
| | | Small |
| Stage 2 | Sleeve 6 | Big |
| | | Small |
| | Sleeve 7 | Big |
| | | Small |
| | Sleeve 8 | Big |
| | | Small |
| | Sleeve 9 | Big |
| | | Small |
| | Sleeve 10 | Big |
| | | Small |
| Stage 3 | Sleeve 11 | Normal |
| | | Small |
| | Sleeve 12 | Normal |
| | | Small |
| | Sleeve 13 | Normal |
| | | Small |
| | Sleeve 14 | Normal |
| | | Small |
| | Sleeve 15 | Normal |
| | | Small |

FIG. 20

| | | |
|---|---|---|
| Stage 1 | Sleeve 1 | Biggest |
| | | Biggest |
| | Sleeve 2 | Biggest |
| | | Biggest |
| | Sleeve 3 | Biggest |
| | | Biggest |
| | Sleeve 4 | Biggest |
| | | Biggest |
| | Sleeve 5 | Biggest |
| | | Biggest |
| Stage 2 | Sleeve 6 | Big |
| | | Big |
| | Sleeve 7 | Big |
| | | Big |
| | Sleeve 8 | Big |
| | | Big |
| | Sleeve 9 | Big |
| | | Big |
| | Sleeve 10 | Big |
| | | Big |
| Stage 3 | Sleeve 11 | Normal |
| | | Normal |
| | Sleeve 12 | Normal |
| | | Normal |
| | Sleeve 13 | Normal |
| | | Normal |
| | Sleeve 14 | Normal |
| | | Normal |
| | Sleeve 15 | Normal |
| | | Normal |

METHODS AND SYSTEMS FOR A PIN POINT FRAC SLEEVES SYSTEM

CROSS-REFERENCE TO RELATED APPLICATIONS

This application is related to U.S. Ser. No. 14/987,559 filed Jan. 4, 2016, which is fully incorporated herein by reference in its entirety.

BACKGROUND INFORMATION

Field of the Disclosure

Examples of the present disclosure relate to frac sleeve with set of inner sleeves that allow selective opening and closing of such sleeves.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Additionally, during the fracturing process, tools may be pumped through frac sleeves to enhance the production of the natural resources. One of the tools pumped through the frac sleeves are frac-balls. The frac-balls are configured to block off or close portions of a well to allow pressure to build up, causing the cracks or fractures in the geological formations and in other cases to shut these openings and isolate existing fracture to prevent production of un-required fluid.

Current or existing completion strings utilizing frac sleeves in wellbores are comprised of a plurality of frac sleeves, each having tapered sidewalls. In order to activate each frac sleeve, properly sized frac-balls are pumped along with the mixture inside of the wellbore. Subsequent pumped frac-balls have a larger diameter. Thus, current or existing completion strings utilizing frac sleeves in wellbores require frac-balls of proper size to be sequentially pumped into a completion string.

When a properly sized frac-ball is positioned within a corresponding frac sleeve, the positioning of the frac-ball exerts pressure causing the frac sleeve activation or opening, consequently causing the pressure to fracture or crack in the geological formation. At the completion of each fracturing stage, a larger sized frac-ball is injected into the completion string, which opens up the next frac sleeve. This process repeats until all of the frac sleeves are opened, and multiple fractures are created in the wellbore.

Thus, conventional wellbores force fracturing to occur at the lowest frac sleeve first. This causes completion strings to be prone to accumulate undesired sand or mixtures in the wellbore after a fracking stage. Additionally, conventional wellbores rely on tapered frac sleeves corresponding to different sized frac-balls. This limits the number of stages in a completion string and frac rate due to the huge pressure drop across the frac sleeves with the smallest ball seats and limits the ability to efficiently treat the geological formation under consideration. After the multiple fractures are created in conventional wellbores, additional fractures cannot be created without intervention for mechanical activation.

Further, a group of sleeves with the same ball seat size are all opened together and treated together, hence not allowing each zone to be treated independently, i.e.: pin point.

Accordingly, needs exist for system and methods utilizing a frac-sleeve with an upper sleeve and a lower sleeve or more to allow the frac-sleeve of same size to be used more than once in the same string, while allowing each zone to be treated independently from the other, i.e: pin point.

SUMMARY

Embodiments disclosed herein describe a frac sleeve with ball seats. More specifically, embodiments include two inner sleeves within a frac sleeve configured to allow a single ball to treat a plurality of zones associated with a plurality of frac sleeves while independently pin pointing treatment for each zone. This may allow for the frac sleeves to be utilized heel to toe within a cluster comprised of many sleeves, and with a plurality of different clusters, wherein the clusters may be the whole well. However, in alternative embodiments, the frac sleeve may be utilized in toe to heel configurations. Embodiments may be implemented in either cemented or un-cemented applications and in any well bore trajectory, i.e.: Vertical Wells, Horizontal Wells, etc.

Embodiments may include a frac sleeve with an outer sidewall and inner sleeves. The inner sleeves include a lower sleeve and an upper sleeve.

The outer sidewall may include an outer frac port, a production port, multiple locking mechanisms, and a linearly adjustable member. In embodiments, the production port may be angled to minimize the distance between second ends of the production port and the frac port, while increasing the distance between the first ends of the production port and the frac port. In embodiments, the first ends of the production port and the frac port may be positioned within the frac sleeve, and the second ends of the production port and the frac port may be positioned outside of the frac sleeve.

The inner lower sleeve may include a lower frac port and a first ball seat.

The inner upper sleeve may include an upper production port and a second ball seat. In embodiments, the first ball may be smaller than the first ball.

In embodiments, a first frac-ball may be dropped within the inner sleeves, pass through the second ball seat, and be positioned on the first ball seat. When the first frac-ball is positioned on the first ball seat, pressure may be applied within the frac sleeve to compress the linearly adjustable member.

Responsive to compressing the linearly adjustable member, the lower inner sleeve may slide linearly within the outer sidewall, while the upper inner sleeve may remain in a fixed position.

In embodiments, responsive to linearly moving the lower inner sleeve, the outer frac port may become aligned with the lower frac port. When the outer frac port and lower frac port are aligned, fracking fluid may be transmitted from a position within the inner sleeve to a position outside of the outer sidewall via the aligned frac ports.

In embodiments, as the pressure within the frac sleeve is decreased, the inearly adjustable member may expand. Responsive to expanding the linearly adjustable member, the lower inner frac sleeve may slide upward causing the first ball seat to be aligned with a first locking mechanism.

When the first ball seat is aligned with the first locking mechanism, the first ball seat may open horizontally into the first locking mechanism. Once the first ball seat open, a diameter of the lower ball seat may have a diameter that is greater than the first frac-ball. This may allow the first frac-ball to slide through the linearly adjustable member and the first ball seat. Once sliding through, the first frac-ball may fall through the first frac sleeve into a lower positioned, second frac sleeve.

Additionally, when the linearly adjustable member is elongate or contract, the lower port may be aligned with the angled production port, while the lower frac sleeve blocks passage of fluid through the outer frac port.

In embodiments, a second frac-ball may be dropped within the inner sleeves, and be positioned on the second ball seat. When the second frac-ball is positioned on the second ball seat, pressure may be applied within the frac sleeve. This pressure may move the upper inner frac sleeve downward. Responsive to sliding the upper inner sleeve downward, the upper production port may be aligned with the lower frac port and the angled production port. This may allow the angled production port to be utilized.

To this end, embodiments may utilize two different ports, wherein a first port may be used for fracturing and stimulation and a second port may be used for production. The two inner frac sleeves may be used independently to open and close the different ports. When the inner frac sleeves are not meant to be utilized, the inner ports may not align with the ports within the outer sidewall.

Additionally, different stages of frac sleeves may utilize different sized frac balls. Accordingly, a first frac ball for a first frac-sleeve may be used as the second frac ball for a second frac-sleeve, wherein the first frac-sleeve may be positioned above the second frac-sleeve.

In other words, after a frac ball is utilized to open the fracturing port of the first frac-sleeve, the frac ball may drop through the first frac-sleeve and enter into the second frac-sleeve. Once the frac ball is within the second frac-sleeve, the frac ball may be utilized to open the production port of the subsequent, second frac-sleeve. Thus, after achieving fracturing of an upper frac-sleeve, the frac ball may drop to a lower frac sleeve to open the production ports for all the subsequent frac sleeves. A lowest frac sleeve in a cluster, may have a solid second ball seat. This may prevent a frac-ball from passing through the lowest frac-sleeve.

Utilizing the frac-balls, embodiments may allow the fracking process to occur from an uppermost frac sleeve to a lowermost frac sleeve. This may allow excess sand and fluid to flow downward, which may save fluid and leaving less sand in the well. Additionally, utilizing embodiments a seamless infinite number of fracking sleeves may utilize the frac-balls for production. This may allow more fractures across a completion string.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

FIGS. 17-20 depict tables indicating stages comprised of a plurality of frac sleeves.

Figure 1:
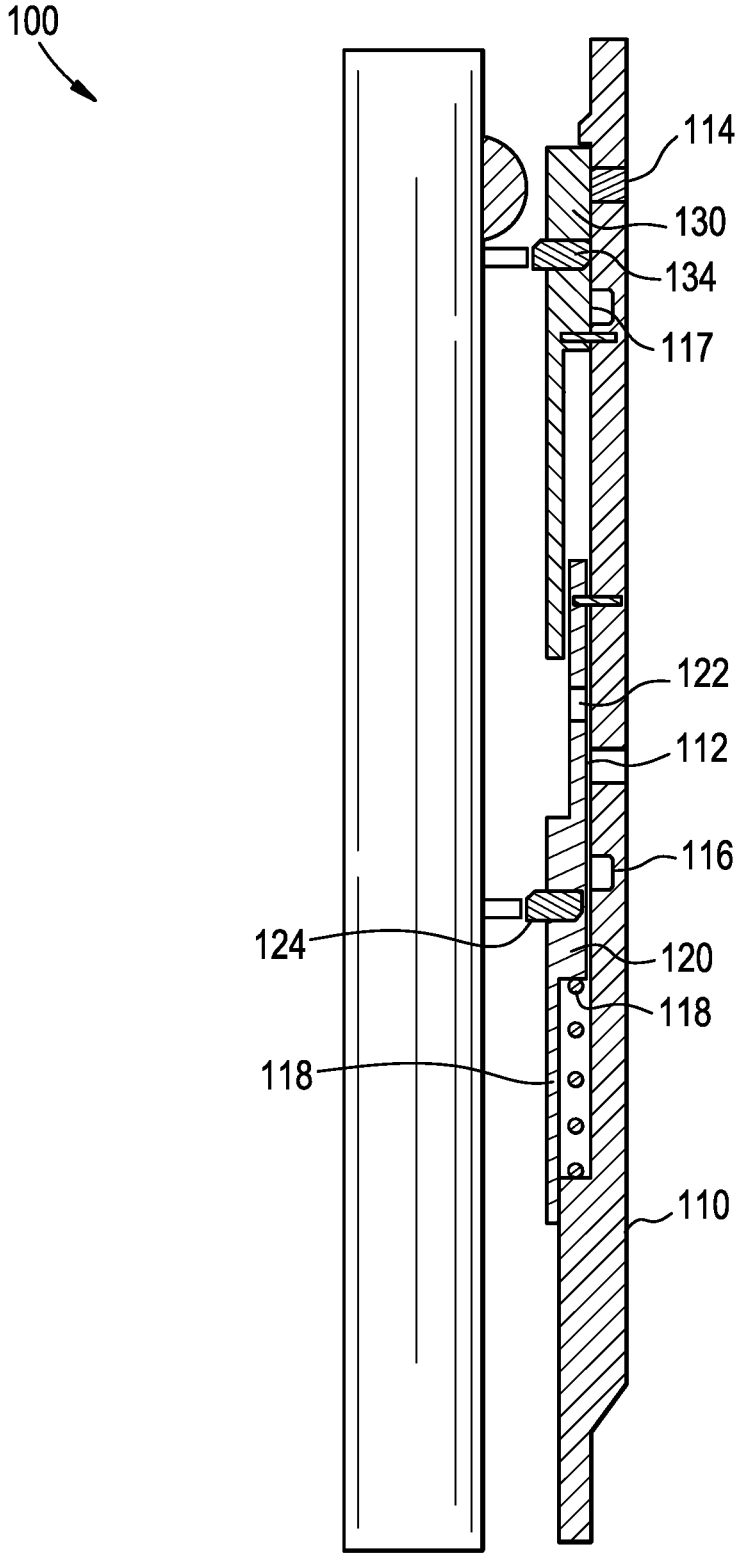
FIG. 1 depicts a frac sleeve, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Examples of the present disclosure relate to a frac sleeve with various inners sleeves and ball seats. More specifically, embodiments include inner sleeves and ball seat within a frac sleeve configured to allow a single frac-ball to independently open or close plurality of zones associated with a plurality of frac sleeves while still treat or pinpoint each zone independent from the other.

Turning now to FIG. 1, FIG. 1 depicts a frac sleeve 100, according to an embodiment. In embodiments, a wellbore may include a plurality of frac sleeves 100, which may be vertically/linearly aligned across their axis with one another. The plurality of frac sleeves 100 may be vertically/linearly aligned such that a first frac sleeve 100 is positioned above a second frac sleeve 100. Accordingly, the frac sleeves 100 may be aligned in parallel to a longitudinal axis of frac sleeve 100. Each frac sleeve 100 may be utilized to control the flow of fluid, gases, mixtures, etc. within a stage of a wellbore.

Frac sleeve 100 may include outer sidewall 110, lower inner sleeve 120, upper inner sleeve 130. Outer sidewall 110, lower inner sleeve 120, upper inner sleeve 130 may form a hollow chamber, channel, conduit, passageway, etc. The hollow chamber may extend from a top surface of outer sidewall 110 and upper inner sleeve 130 to a lower surface of outer sidewall 110 and lower inner sleeve 120. Furthermore, lower inner sleeve 120 may not be coupled or sealed with upper inner sleeve 130. This may allow the inner sleeves to operate independently, and prevent Hydraulic lock/atmospheric effects within the hollow chamber.

Lower inner sleeve 120 may be positioned within the hollow channel, and be positioned adjacent to outer sidewall 110. In embodiments, an outer diameter of lower inner sleeve 120 may be positioned adjacent to an inner diameter of outer sidewall 110. Outer sidewall 110 and lower inner sleeve 120 may have parallel longitudinal axes, and may not include tapered sidewalls. In embodiments, lower inner sleeve 120 may be positioned below upper inner sleeve 130. Lower inner sleeve 120 may include lower frac port 122 and first ball seat 124.

Lower frac port 122 may be an opening, orifice, etc. extending through lower inner sleeve 120. Lower frac port 122 may be configured to control the flow of fluid, fracking materials, and natural resources through the hollow chamber. In embodiments, lower frac port 122 may be configured to be misaligned and aligned with outer frac port 112. When lower frac port 122 is misaligned with outer frac port 112, the sidewalls of inner sleeve 120 may form a seal, and may not allow fluid to flow from the hollow into the geological formations via outer frac port 112.

First ball seat 124 may be configured to secure a frac-ball within the hollow chamber. First ball seat 124 may be comprised of two semi-circles with a hollow center, wherein the hollow center of first ball seat 124 is configured to have a variable diameter. In other words, first ball seat 124 may be substantially donut shaped. However, in other embodiments, the ball seats may be any shape or size with a passageway extending through the ball seat.

The variable diameter of first ball seat 124 may change based on a diameter of a structure positioned adjacent to the outer diameter circumference of first ball seat 124. Thus, first ball seat 124 may change to have a circumference substantially the same size as the structure positioned adjacent to the outer diameter of first ball seat 124. When first ball seat 124 is positioned in the hollow chamber, first ball seat 124 may have a first diameter. When first ball seat 124 is positioned within first locking mechanism 116, first ball seat 124 may have a second diameter, wherein the first diameter is smaller than the second diameter.

Upper inner sleeve 130 may be positioned within the hollow channel, and be positioned adjacent to outer sidewall 110. In embodiments, an outer diameter of upper inner sleeve 130 may be positioned adjacent to an inner diameter of outer sidewall 110. Outer sidewall 110 and upper inner sleeve 130 may have parallel longitudinal axis, and may not include tapered sidewalls. In embodiments, upper inner sleeve 130 may be positioned above lower inner sleeve 120. Upper inner sleeve 130 may include second ball seat 134.

Second ball seat 134 may be configured to secure a frac-ball within the hollow chamber. Second ball seat 134 may be comprised of two semi-circles with a hollow center, wherein the hollow center of second ball seat 134 is configured to have a variable diameter. In other words, second ball seat 134 may be substantially donut shaped.

The variable diameter of second ball seat 134 may change based on a diameter of a structure positioned adjacent to the outer diameter circumference of second ball seat 134. Thus, second ball seat 134 may change to have a circumference substantially the same size as the structure positioned adjacent to the outer diameter of second ball seat 134. When second ball seat 134 is positioned adjacent to the hollow chamber, second ball seat 134 may have a third diameter. When second ball seat 134 is positioned within second locking mechanism 117, second ball seat 134 may have a fourth diameter, wherein the third diameter is smaller than the fourth diameter. Additionally, the third diameter may be greater than the first diameter of the first ball seat 124. Therefore, a frac ball may be able to pass through second ball seat 134 but not first ball seat 124.

Outer sidewall 110 may include frac port 112, production port 114, first locking mechanism 116, second locking mechanism 117, and linearly adjustable member 118.

Frac port 112 may be an opening, orifice, etc. extending through outer sidewall 110. Frac port 112 may be configured to control the flow of fluid, fracking materials, natural resources and any fluid through the hollow chamber. In embodiments, frac port 112 may be configured to be misaligned and aligned with a lower port 122 positioned through lower inner sleeve 120. When misaligned with the lower port 122 within lower inner sleeve 120, frac port 112 may be sealed. When aligned with the lower port 122 within lower inner sleeve 120, frac port 112 may allow frac sleeve 100 to be operational.

Production port 114 may be an opening, orifice, etc. extending through outer sidewall 110. Production port 114 may be positioned above frac port 112. Production port 114 may be filled with or include variable material. For example, production port 114 may be filled with a dissolvable material that may be removed after a certain amount of time or after fluid pressure is applied to the removable material or after certain fluid is pumped around. In other embodiments, the removable material may be a door, flap, entrance, etc. that is configured to extend through the production port 114. The door may seal production port 114 when extended. However, the door may be configured to rotate, move, etc. to be recessed in outer sidewall 110, etc. When rotated or moved, the door may form an opening through production port 114.

In embodiments, production port 114 may be configured to be misaligned and aligned with a sidewall of upper inner sleeve 120. When misaligned with sidewall of upper inner sleeve 120, production port 114 may be sealed. However, when an upper edge of upper inner sleeve 120 is positioned below production port 114, production port 114 may be utilized to receive materials from outside of outer sidewall 110 or from inside of the sleeve 110. Thus, allowing frac sleeve 100 to be operational. In embodiments, production port 114 and frac port 112 may not be operational simultaneously.

First locking mechanism 116 may be an opening, orifice, recess, profile etc. extending from the inner diameter of outer sidewall 110 towards the outer diameter of outer sidewall 110. However, the opening associated with first locking mechanism 116 may not extend completely through outer sidewall 110. Accordingly, a diameter across first locking mechanism 116 may be larger than the diameter across the inner diameter of outer sidewall 110, but less than the diameter across the outer diameter of outer sidewall 110. First locking mechanism 116 may be a recess within outer sidewall 110 that is configured to receive first ball seat 124. In embodiments, first locking mechanism 116 may be positioned below frac port 112, and above linearly adjustable member 118. Responsive to first ball seat 124 being horizontally aligned with first locking mechanism 116, the diameter of first ball seat 124 may enlarge with first locking mechanism 116.

Second locking mechanism 117 may be an opening, orifice, recess, profile etc. extending from the inner diameter of outer sidewall 110 towards the outer diameter of outer sidewall 110. However, the opening associated with Second locking mechanism 117 may not extend completely through outer sidewall 110. Accordingly, a diameter across a second locking mechanism 117 may be larger than the diameter across the inner diameter of outer sidewall 110, but less than the diameter across the outer diameter of outer sidewall 110. In embodiments, second locking mechanism 117 may be positioned above frac port 112 and below production port 114. Second locking mechanism 117 may be a recession within outer sidewall 110 that is configured to receive second ball seat 134. Responsive to second ball seat 134 being horizontally aligned with second locking mechanism 117, the diameter of second ball seat 134 may change within second locking mechanism 117.

Linearly adjustable member 118 may be a device or fluid chamber that is configured to linearly move lower inner sleeve 120. For example, linearly adjustable member 118 may be a spring, hydraulic lift, etc. Linearly adjustable member 118 may be positioned below first locking mechanism 116. However, in other embodiment's Linearly adjustable member 118 may be positioned in various places in relation to inner sleeve. In embodiments, a lower surface of Linearly adjustable member 118 may be positioned adjacent to a lower ledge, and an upper surface of Linearly adjustable member 118 may be positioned adjacent to an upper ledge, projection, protraction, etc. on lower inner sleeve 120. Responsive to being compressed or elongated, lower inner sleeve 120 may slide within outer sidewall 110. When Linearly adjustable member 118 is compressed or elongated, first ball seat 124 may correspondingly move.

FIGS. 2-7 depict phases of a method 200 for operating a sliding frac sleeve 100. The operations of the method depicted in FIGS. 2-7 are intended to be illustrative. In some embodiments, the method may be accomplished with one or more additional operations not described, and/or without one or more of the operations discussed. Additionally, the order in which the operations of the method are illustrated in FIGS. 2-7 and described below is not intended to be limiting. Elements depicted in FIGS. 2-7 may be described above. For the sake of brevity, a further description of these elements is omitted.

Figure 2:
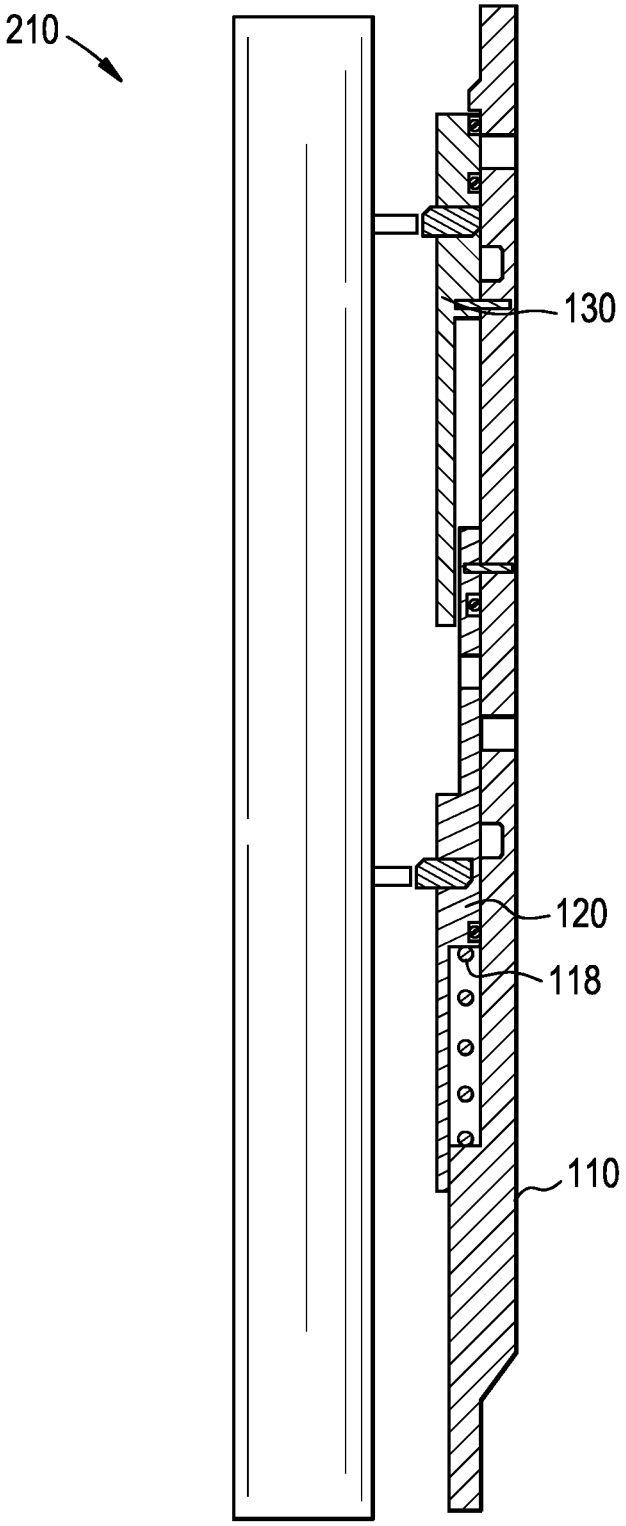
FIG. 2 depicts a first operation utilizing a frac sleeve, according to an embodiment.

FIG. 2 depicts a first operation 210 utilizing frac sleeve 100. At operation 210, frac sleeve 100 may be positioned within a geological formation with natural resources that are desired to be extracted, or across a geological formation where injection of fluid is desired.

In operation 210, Linearly adjustable member 118 may be partially extended. Additionally, the ports within lower inner sleeve 120 and upper inner sleeve 130 may not align with the port on outer sidewall 110. Thus, the hollow chamber within frac sleeve 100 may be sealed from the geological formation.

Figure 3:
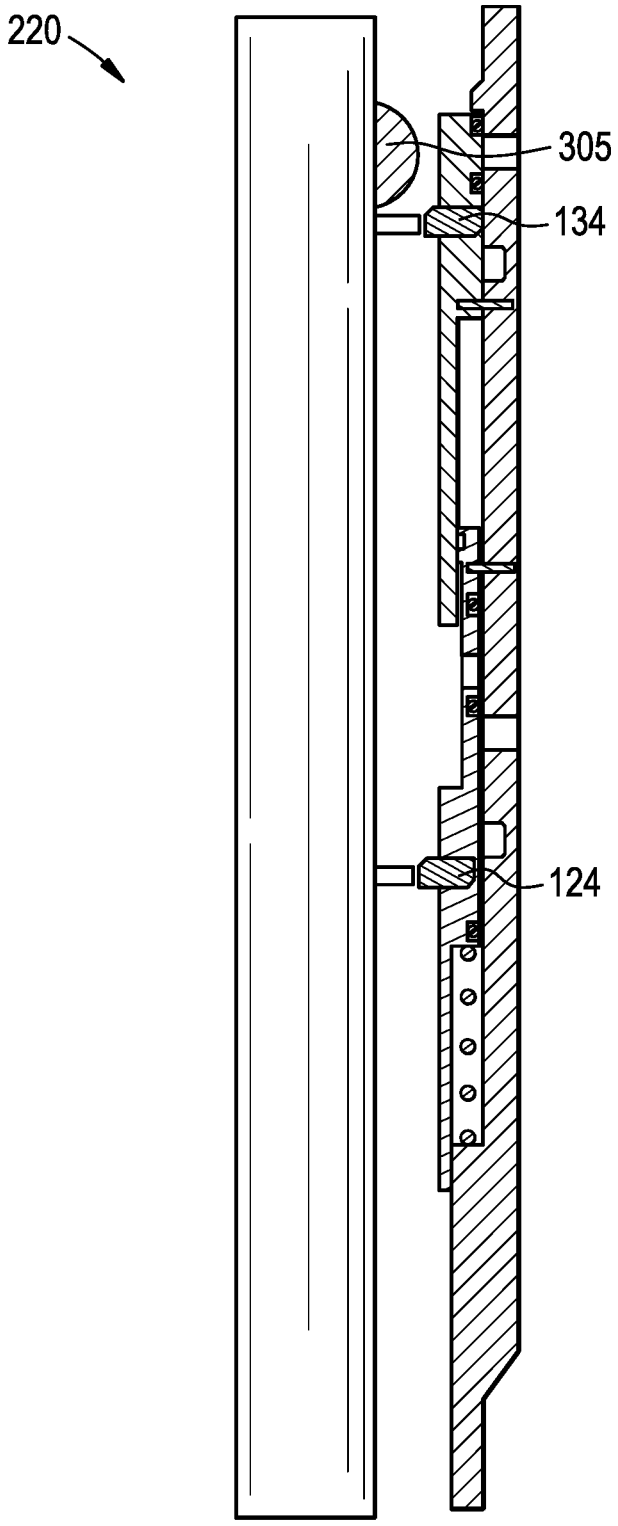
FIG. 3 depicts a second operation utilizing a frac sleeve, according to an embodiment.

FIG. 3 depicts a second operation 220 utilizing frac sleeve 100. At operation 220, a first frac-ball 305 may be inserted within the hollow chamber. The first frac ball 305 may enter the hollow chamber from a first end of frac sleeve 100. The first frac-ball 305 may pass through the second ball seat 134. The frac-ball 305 may pass through the second ball seat 134 due to the second ball seat 134 having a larger diameter than the first ball seat 124.

Figure 4:
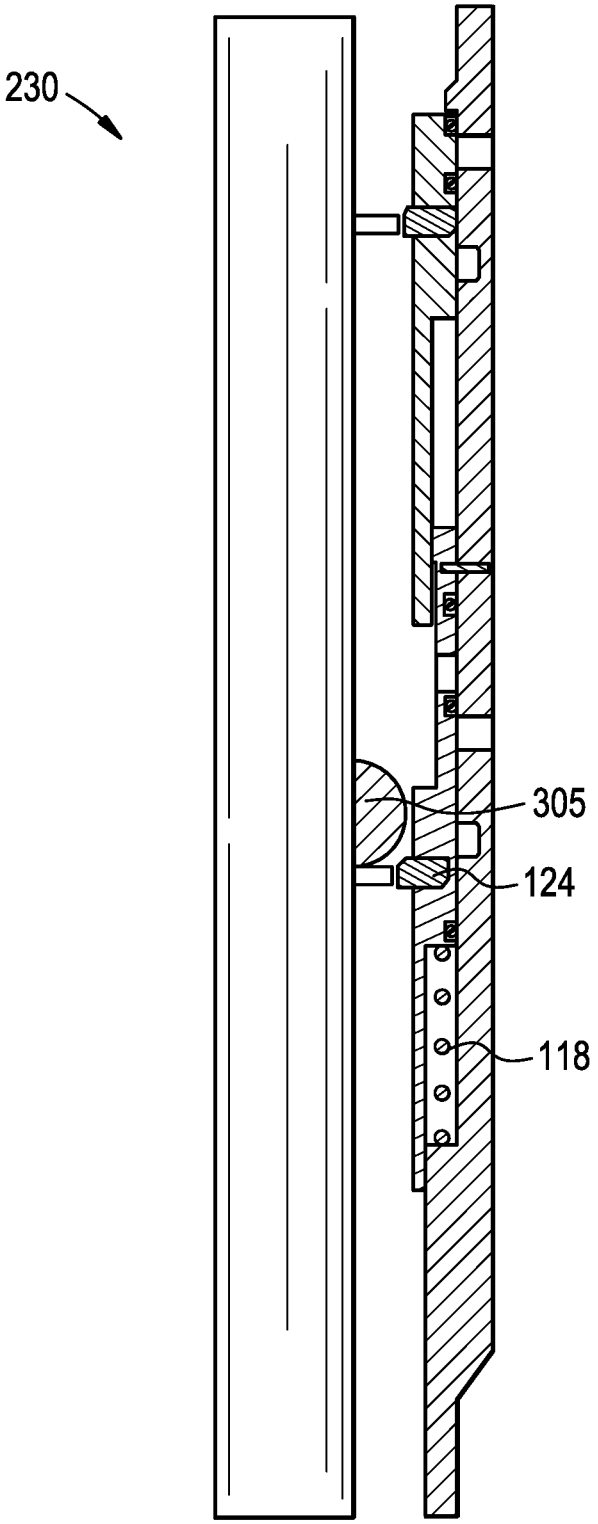
FIG. 4 depicts a third operation utilizing a frac sleeve, according to an embodiment.

FIG. 4 depicts a third operation 230 utilizing frac sleeve 100. At operation 230, the first frac-ball 305 may be positioned on first ball seat 124. While the frac-ball 305 is positioned on first ball seat 124, the pressure within the hollow chamber may be increased. This may force linearly adjustable member 118 to compress and lower inner sleeve 120 to slide within the hollow chamber.

Figure 5:
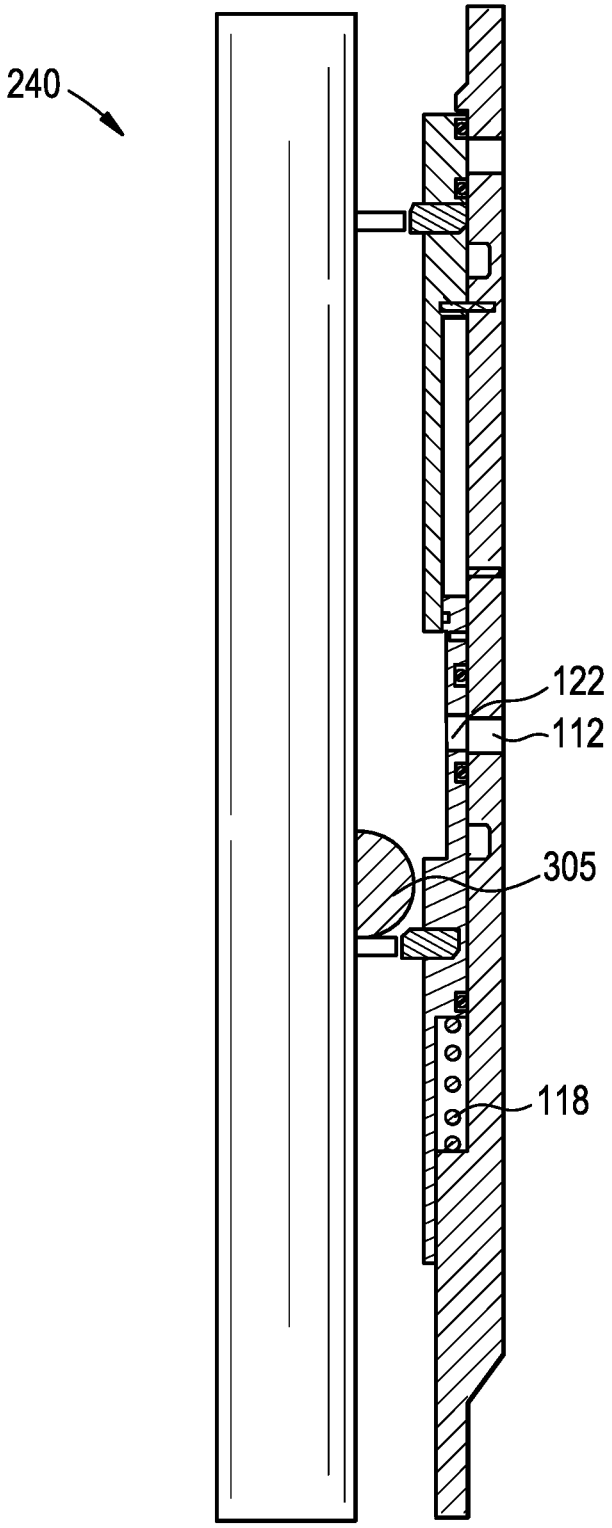
FIG. 5 depicts a fourth operation utilizing a frac sleeve, according to an embodiment.

FIG. 5 depicts a fourth operation 240 utilizing frac sleeve 100. At operation 240, pressure within the hollow chamber may build up due to first frac-ball 305 forming a seal on a second end of the hollow chamber by closing an opening within the center of the first ball seat 124.

As the pressure within the hollow chamber increases, the pressure may break shear screws or other elements holding lower inner sleeve in place allowing linearly adjustable member 118 to compress. Responsive to linearly adjustable member 118 compressing, lower inner sleeve 120 may slide downward to align lower frac port 122 with outer frac port 112.

Figure 6:
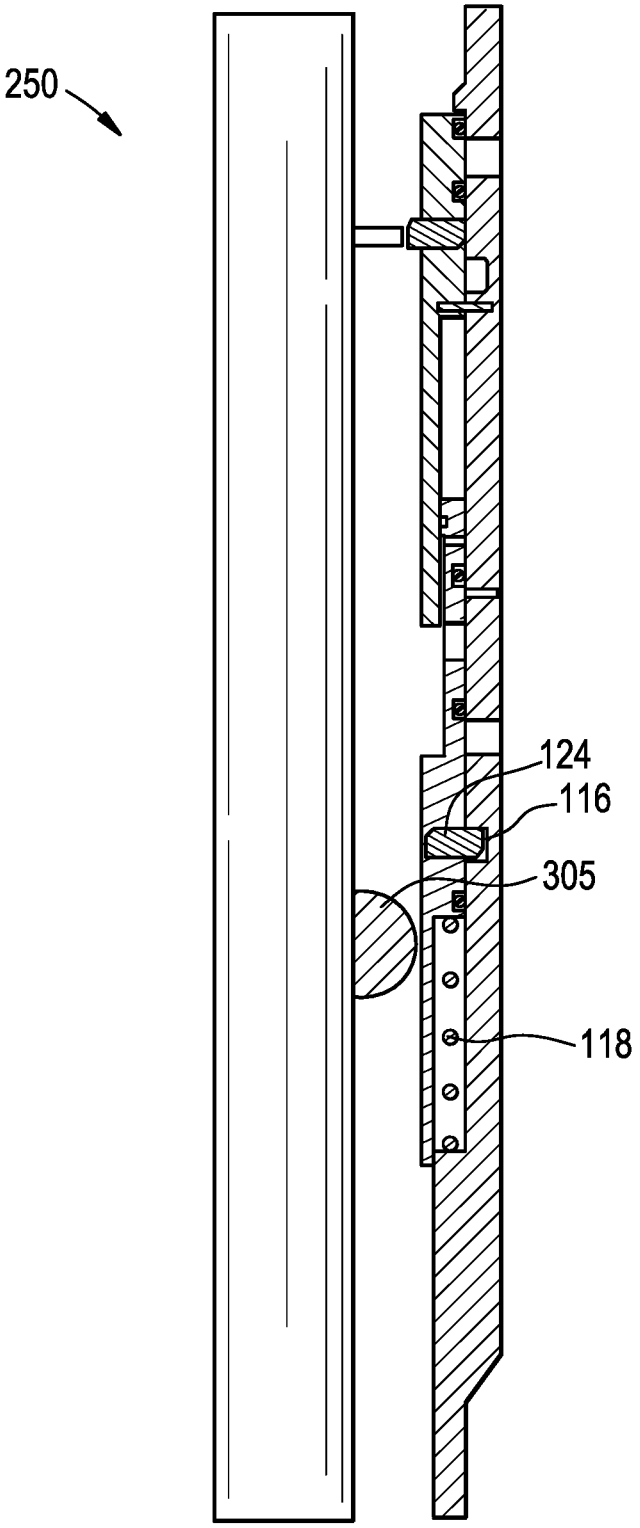
FIG. 6 depicts a fifth operation utilizing a frac sleeve, according to an embodiment.

FIG. 6 depicts a fifth operation 250 utilizing frac sleeve 100. At operation 250, the pressure within the hollow chamber may decrease. This may allow linearly adjustable member 118 to be elongated and rise above its initial vertical offset. When linearly adjustable member 118 is elongated, first ball seat 124 may be horizontally aligned with first locking mechanism 116. When aligned, linearly adjustable member 118 may expand to increase the inner and outer circumference of first ball seat 124. This may cause lower inner sleeve 120 to be locked in place, wherein the positioning of lower inner sleeve 120 and outer sidewall 110 may misalign lower frac port 122 with outer frac port 112 to not form a passageway.

Furthermore, when the inner circumference of first ball seat 124 increases, the first frac ball 305 may move downward through the hollow chamber and through the second end of frac sleeve 100.

The above operations may be repeated a plurality of times for multiple frac-sleeves, wherein the same first frac ball may be utilized to align multiple frac ports within inner sleeves and outer frac ports within outer sidewalls.

Figure 7:
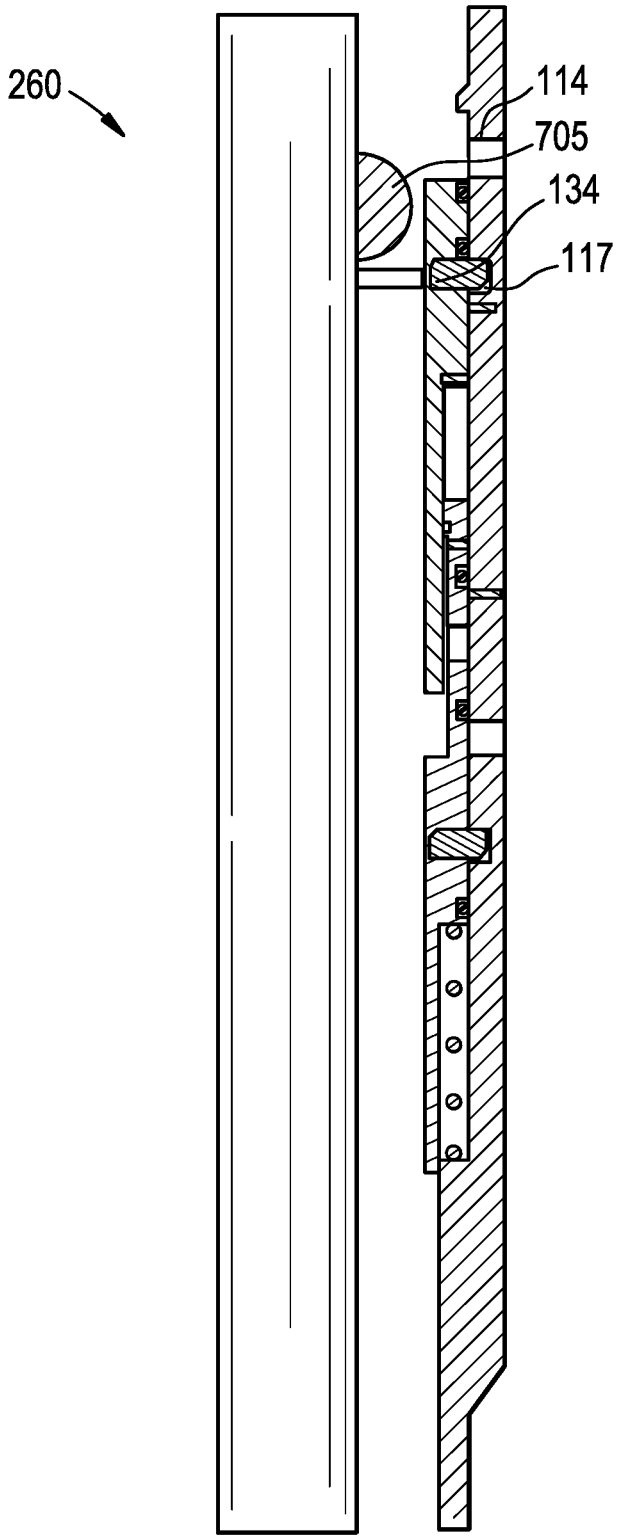
FIG. 7 depicts a sixth operation utilizing a frac sleeve, according to an embodiment.

FIG. 7 depicts a sixth operation 260 utilizing frac sleeve 100. At operation 260, a second frac-ball 705 may be inserted within the hollow chamber. The second frac ball may enter the hollow chamber from a first end of frac sleeve 100, wherein the second frac ball has a larger diameter than the first frac ball. Pressure within the hollow chamber may build up due to the second frac-ball forming a seal on a second end of the hollow chamber by closing an opening within the center of the second ball seat 134.

As the pressure within the hollow chamber increases, the pressure may break shear sscrews or other elements holding upper inner sleeve 130. Responsive to the shear sscrews breaking, upper inner sleeve 130 may slide downward to position an upper surface of upper inner sleeve 130 below production port 114. When upper inner sleeve 130 is positioned below production port 114, frac sleeve 100 may be open for production or to allow various formation treatment.

Furthermore, when upper inner sleeve 130 is positioned below production port 114, second ball seat 134 may be horizontally aligned with second locking mechanism 117. When aligned, second ball seat 134 may change to increase the inner and outer circumference of second ball seat 134. This may cause upper inner sleeve 130 to be locked in place. Additionally, when the inner circumference of second ball seat 134 increases, the second frac ball may move downward through the hollow chamber and through the second end of frac sleeve 100.

Figure 8:
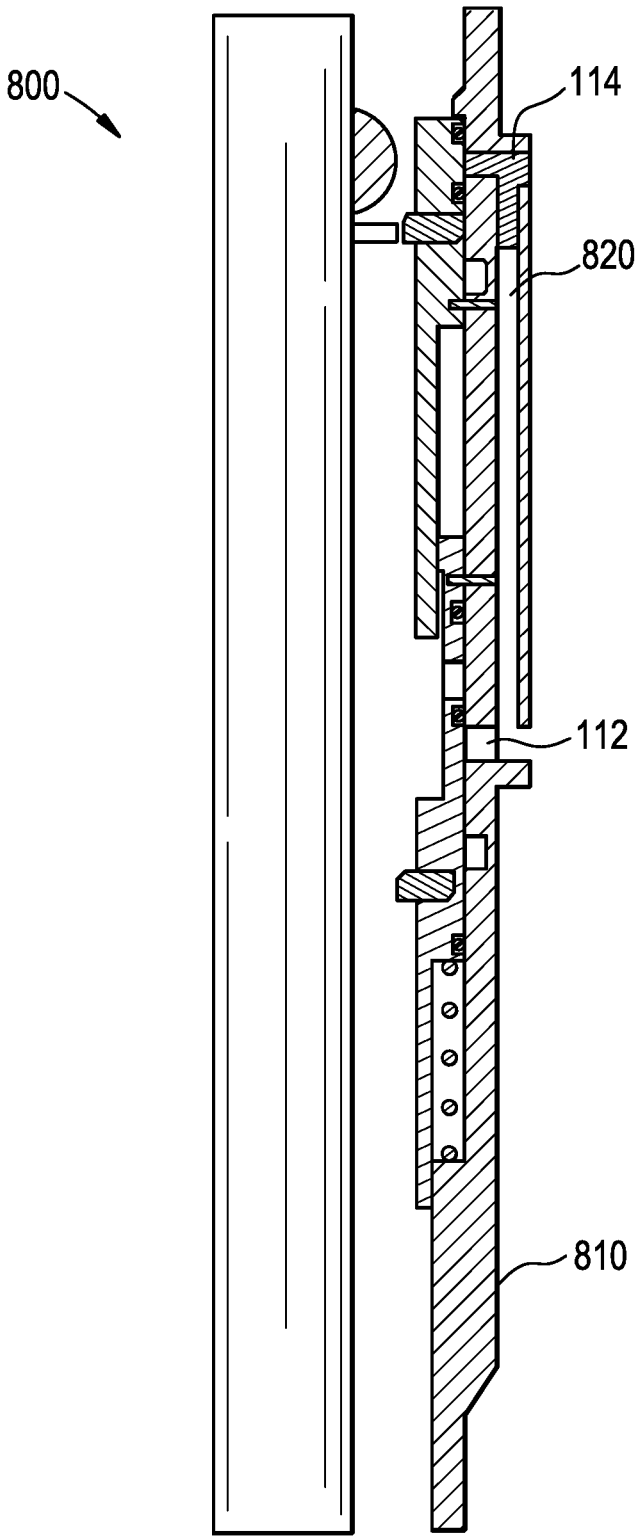
FIG. 8 depicts a frac sleeve, according to an embodiment, according to an embodiment.

FIG. 8 depicts a frac sleeve 800, according to an embodiment. Elements depicted in FIG. 8 may be substantially the same as those described above. For the sake of brevity an additional description of those elements is omitted.

Frac sleeve 800 may include holes 820 in outer sidewall 810. The holes 820 may be utilized to provide a passageway between the production port and the frac port within outer sidewall 810, such that the production port and frac port may be in communication with each other. Holes 820 may extend through outer sidewall 810 from a lower surface of the production port to an upper surface of the frac port in a direction that is in parallel to the hollow chamber.

Figure 9:
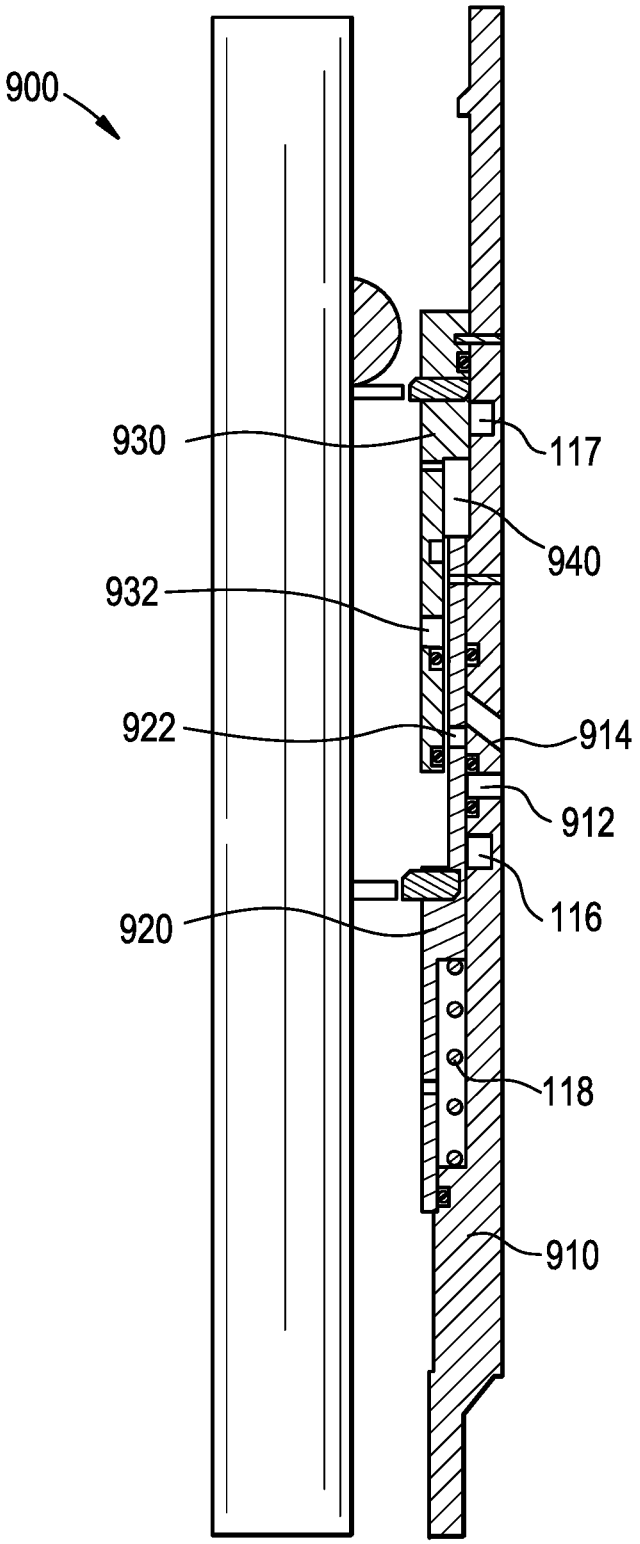
FIG. 9 depicts a frac sleeve, according to an embodiment, according to an embodiment.

FIG. 9 depicts a frac sleeve 900, according to an embodiment. Elements depicted in FIG. 9 may be substantially the same as those described above. For the sake of brevity an additional description of those elements is omitted.

Frac sleeve 900 may include an outer sidewall 910, lower inner sleeve 920, upper inner sleeve 930, and hydraulic vent 940.

Outer sidewall 910 may include frac port 912, angled production port 914, first locking mechanism 116, second locking mechanism 117, Linearly adjustable member 118.

Frac port 912 may be positioned below angled production port 914. Angled production port 914 may be positioned at a downward slope from the hollow chamber towards the circumference of outer sidewall 910. Accordingly, a distance between the first ends of angled production port 914 and frac port 912 may be greater than a distance between the second ends of angled production port 914 and frac port 912. This may assist in well utilization, production, injection, fracking, etc. by having a production port being in closer proximity with the point of fracking.

Lower inner sleeve 920 may include a lower frac port 922. Lower frac port 922 may be initially configured to be positioned between the first ends of frac port 912 and production port, wherein an inner surface of lower frac port 922 is covered by upper inner sleeve 930 in the initial position. Responsive to lower inner sleeve 920 sliding downward, lower frac port 922 may be horizontally aligned with frac port 912 and positioned below a lower surface of upper frac sleeve 930.

Upper inner sleeve 930 may include an upper production port 932. Upper production port 932 may be configured to be initially positioned above a first end of production port 914. Responsive to upper inner sleeve 930 sliding downward and lower inner sleeve 920 sliding upward, upper production port 932 may be aligned with lower frac port 922 and production port 914.

Hydraulic vent 940 may be positioned between upper inner sleeve 930 and the outer sidewall. In embodiments, hydraulic vent 940 may include a passageway extending from the hollow inner chamber into a cavity between upper inner sleeve 930 and the outer sidewall. Hydraulic vent 940 may include a screen that is configured to not allow sand or other solid materials to enter the cavity, but allow fluid to enter and exit the cavity. Responsive to fluid entering and exiting the cavity, the fluid may be utilized to move the sleeves or allow sleeves to freely move independently from each other. In embodiments, responsive to the movement of upper inner sleeve 930 and lower inner sleeve 920 the height of the cavity may increase and decrease.

FIGS. 10-15 depict phases of a method 1000 for operating a sliding frac sleeve 900. The operations of the method depicted in FIGS. 10-15 are intended to be illustrative. In some embodiments, the method may be accomplished with one or more additional operations not described, and/or without one or more of the operations discussed. Additionally, the order in which the operations of the method are illustrated in FIGS. 10-15 and described below is not intended to be limiting. Elements depicted in FIGS. 10-15 may be described above. For the sake of brevity, a further description of these elements is omitted.

Figure 10:
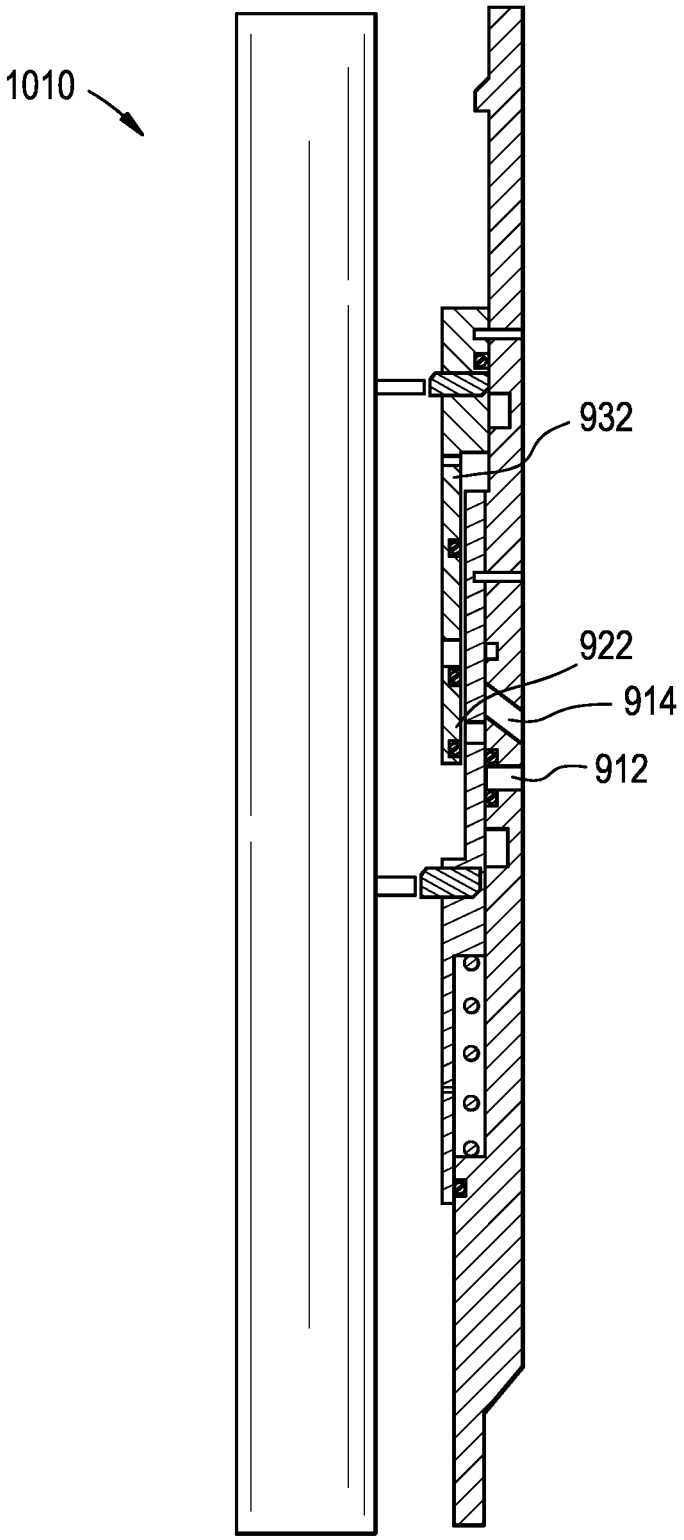
FIG. 10 depicts a first operation utilizing a frac sleeve, according to an embodiment.

FIG. 10 depicts a first operation 1010 utilizing frac sleeve 900. At operation 1010, frac sleeve 900 is in a first position. In the first position, frac port 912 and production port are misaligned with both lower frac port 922 and 932, which are also misaligned.

Figure 11:
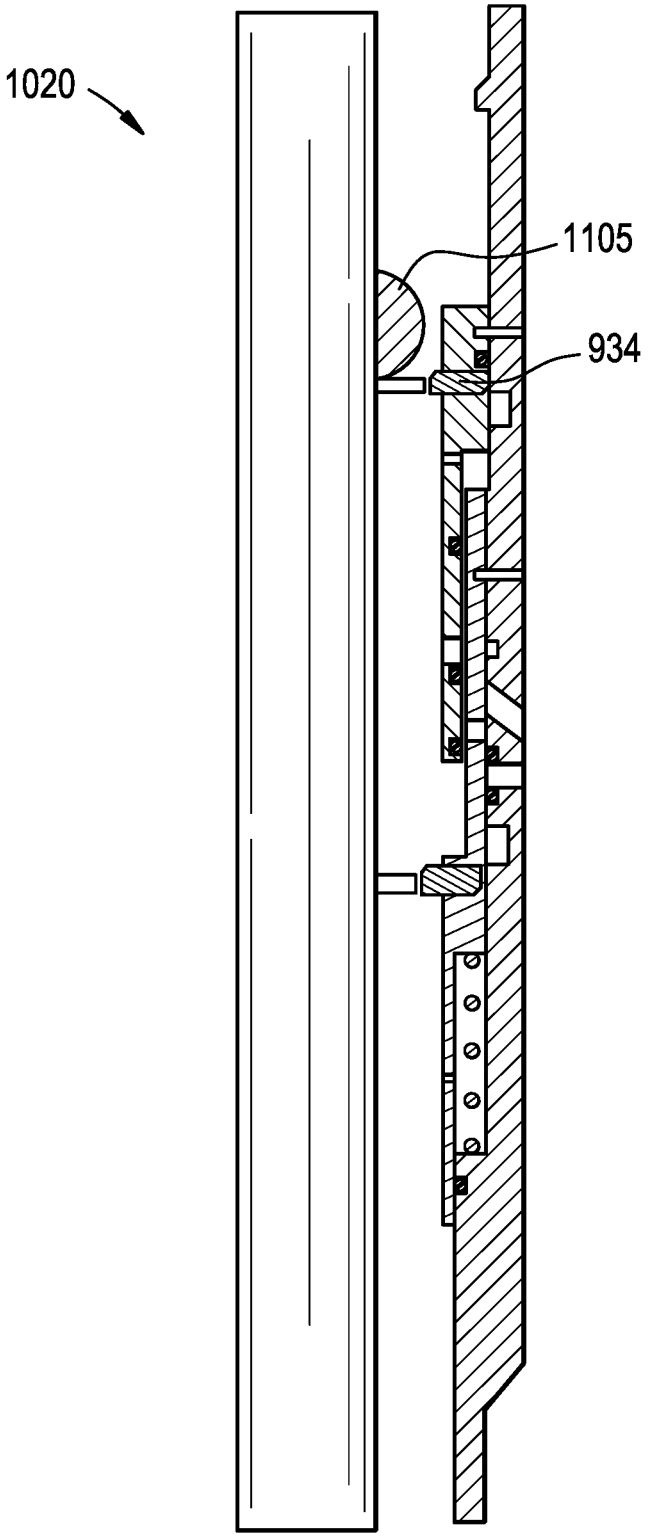
FIG. 11 depicts a second operation utilizing a frac sleeve, according to an embodiment.

FIG. 11 depicts a second operation 1020 utilizing frac sleeve 900. At operation 220, a frac-ball 1105 may be dropped within the hollow chamber. Frac-ball 1105 may enter the hollow chamber within frac sleeve 900 via an opening at the proximal end of frac sleeve 900, and fall towards the distal end of frac sleeve 900. In embodiments, the proximal end of frac sleeve 900 may be coupled to a distal end of another frac sleeve 900, or frac sleeve 900 may be the first frac sleeve 900 in a completion string.

Furthermore, at operation 1020, frac ball 1105 may pass through second ball seat 934, due to second ball seat 934 having an open inner circumference greater than that of frac ball 1105.

Figure 12:
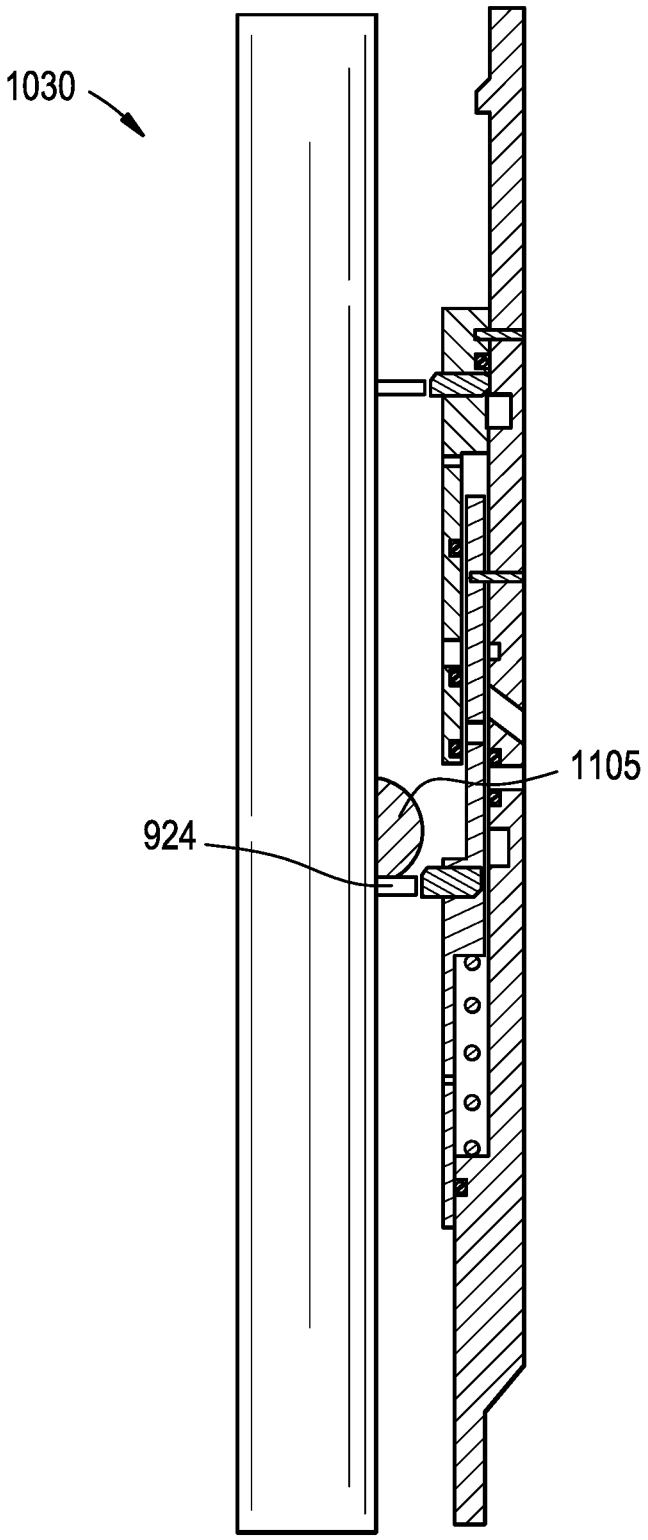
FIG. 12 depicts a third operation utilizing a frac sleeve, according to an embodiment.

FIG. 12 depicts a third operation 1030 utilizing frac sleeve 900. At operation 1030, frac-ball 1105 may land on an upper surface of first ball seat 924, wherein first ball seat 924 may secure frac-ball 1105 in place. Furthermore, at operation 1030, the outer diameter of first ball seat 924 may be substantially the same as the diameter of the inner diameter of outer sidewall 110. Additional, the inner circumference of first ball seat 924 may be less than the circumference of frac ball 1105.

Additionally, at operation 1030 pressure within the hollow chamber may build up due to frac ball 1105 forming a seal on a second end of the hollow chamber by closing an opening within the center of the first ball seat 924.

Figure 13:
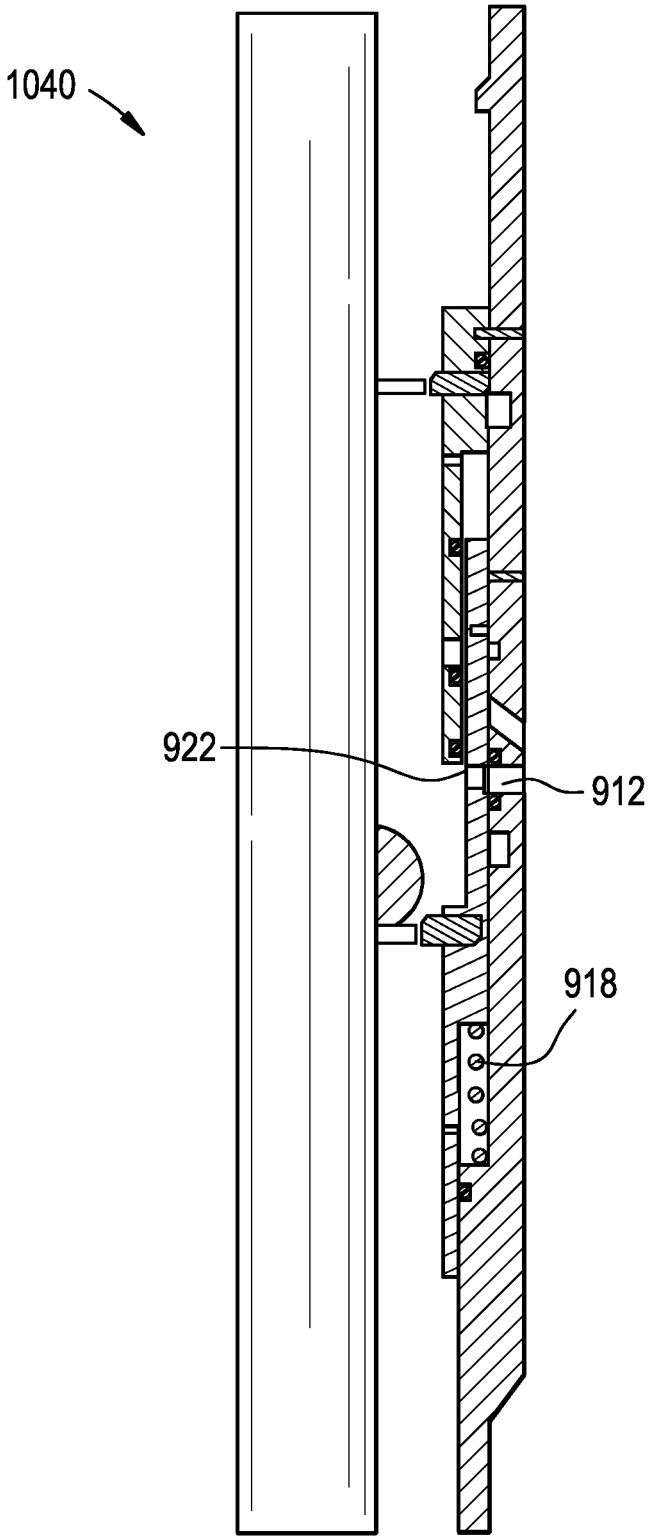
FIG. 13 depicts a fourth operation utilizing a frac sleeve, according to an embodiment.

FIG. 13 depicts a fourth operation 1040 utilizing frac sleeve 900. At operation 1040, the pressure within the hollow chamber may increase to compress linearly adjustable member 918. This may force slide lower frac sleeve 920 downward. When lower inner sleeve 920 is slid downward into a second position, lower frac port 922 may be horizontally aligned with frac port 912 and positioned below a lower surface of upper frac sleeve 930. Furthermore, the movement of lower frac sleeve 920 may be independent of the movement of upper frac sleeve 930, such that upper frac sleeve 930 remains fixed in place.

Figure 14:
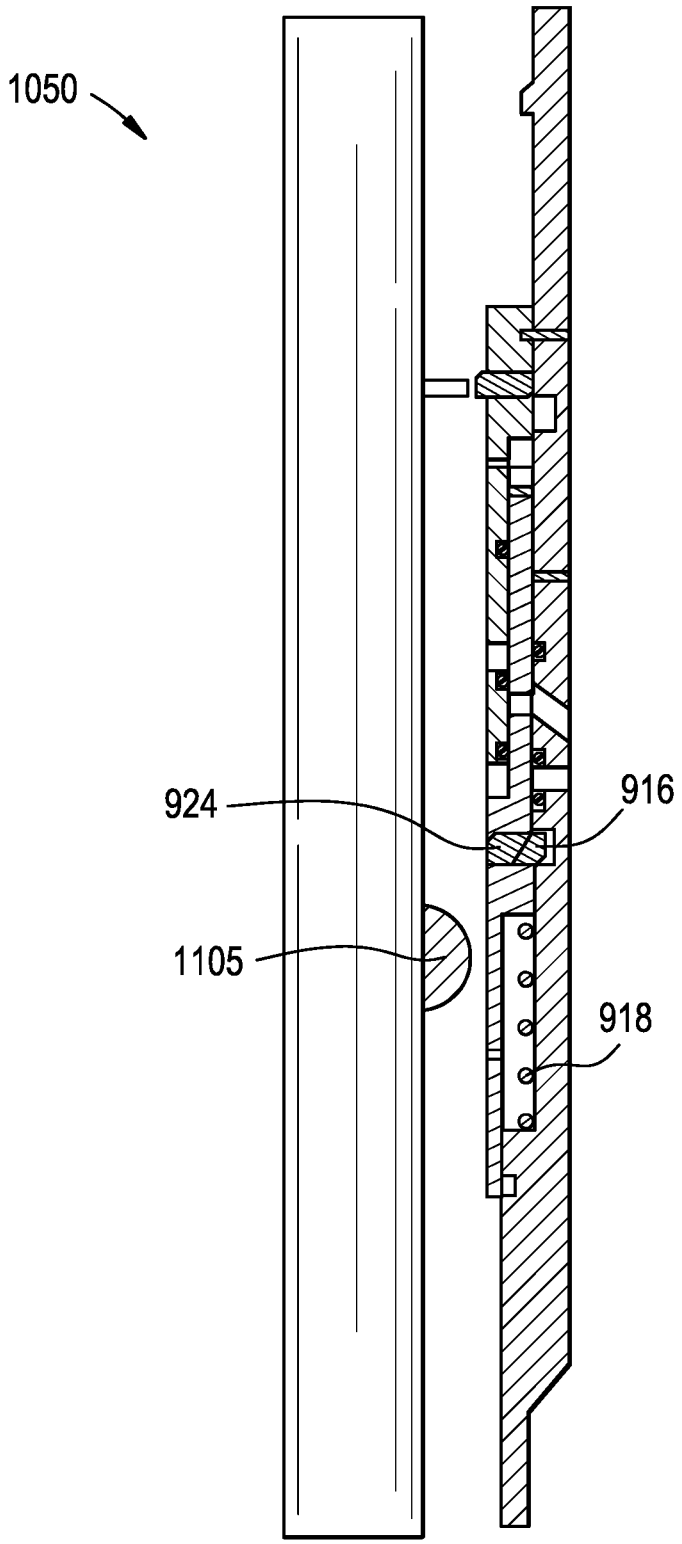
FIG. 14 depicts a fifth operation utilizing a frac sleeve, according to an embodiment.

FIG. 14 depicts a fifth operation 1050 utilizing frac sleeve 900. At operation 1050, the pressure within the hollow chamber may decrease allowing linearly adjustable member 918 to elongate. When linearly adjustable member 918 is elongated, first ball seat 924 may be horizontally aligned with first locking mechanism 916. When aligned, first ball seat 924 may change to increase the inner and outer circumference of first ball seat 924. This may cause lower inner sleeve 920 to be locked in place. Furthermore, when the inner circumference of first ball seat 924 increases, the frac ball 1105 may move downward through the hollow chamber and through the second end of frac sleeve 900.

Additionally, when first ball seat 924 is secured in place, lower frac port 922 may be aligned within production port 114. However, upper inner sleeve 930 may block a passageway through the aligned ports.

Figure 15:
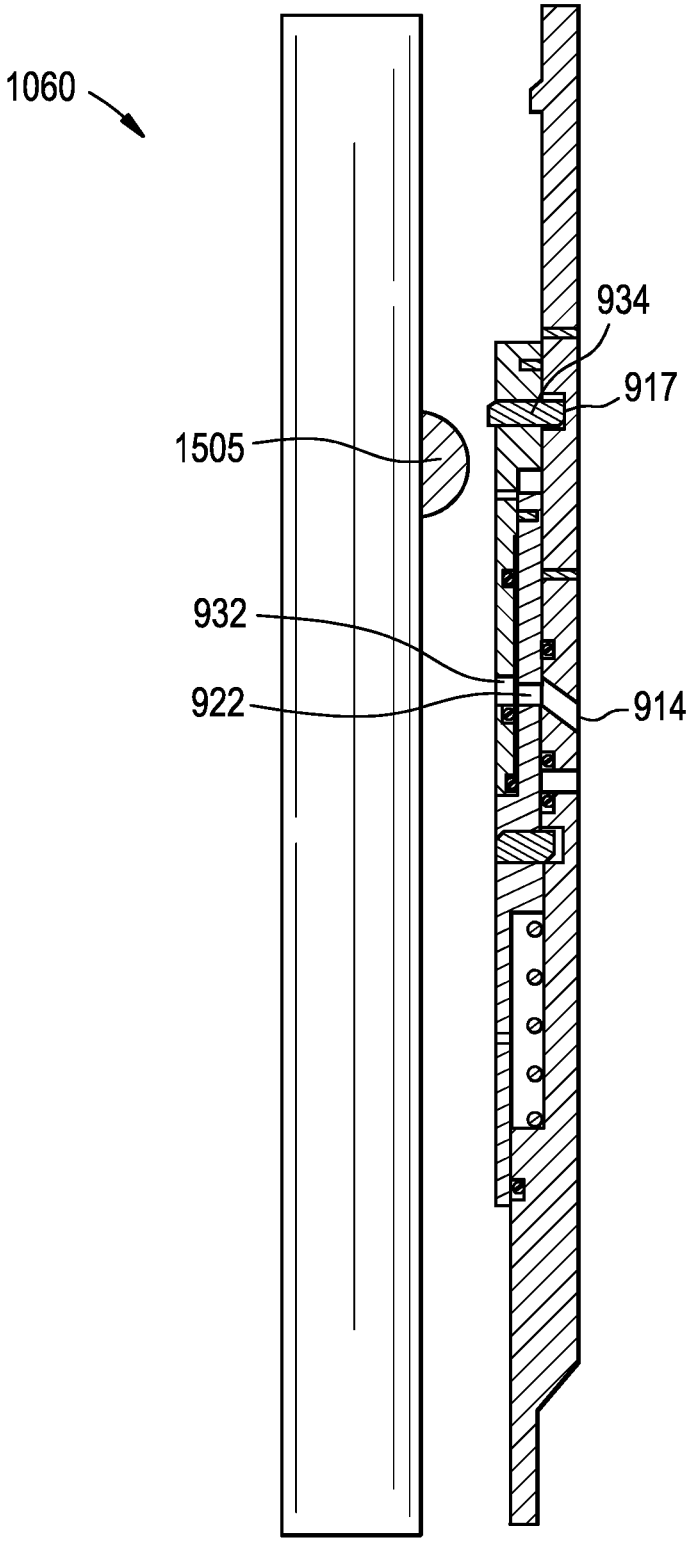
FIG. 15 depicts a sixth operation utilizing a frac sleeve, according to an embodiment.

FIG. 15 depicts a sixth operation 1060 utilizing frac sleeve 900. At operation 1060, a second frac ball 1505 may be dropped within the hollow chamber, and be positioned on second ball seat 134. Responsive to positioning second frac ball 1505 on second ball seat 934, the pressure within the hollow chamber may slide upper inner sleeve 930 downward to be horizontally aligned with second locking mechanism 917. When aligned, second ball seat 934 may change to increase the inner and outer circumference of second ball seat 934. This may cause upper inner sleeve 930 to be locked in place. Furthermore, when the inner circumference of second ball seat 934 increases, the frac ball 1505 may move downward through the hollow chamber and through the second end of frac sleeve 900.

Additionally, when upper inner sleeve 930 slides downward upper frac port 932 may be aligned with lower frac port 922 and production port 114 allowing for utilization of frac sleeve 900, i.e.: Production, injection, etc.

Figure 16:
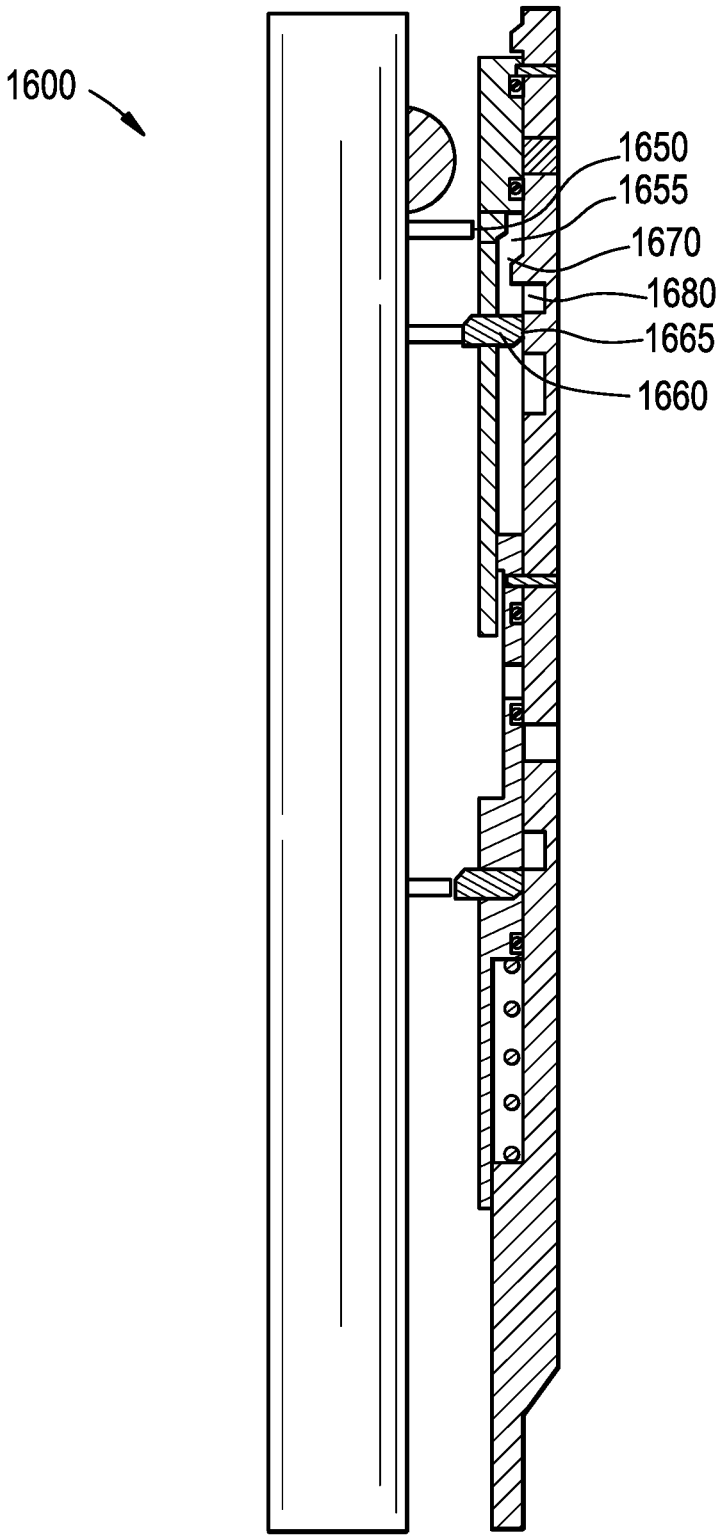
FIG. 16 depicts a frac sleeve, according to an embodiment, according to an embodiment.

FIG. 16 depicts a frac sleeve 1600, according to an embodiment. Elements depicted in FIG. 16 may be substantially the same as those described above. For the sake of brevity an additional description of those elements is omitted.

Frac sleeve 1600 may include an indexing system. The indexing system may be configured to allow a single ball size to be used per sleeve and/or cluster of frac sleeves. This may increase the total number of frac sleeves that can be run per string. The indexing system may include a first indexing seat 1660 and a second indexing seat 1650, wherein the first indexing seat 1660 and second indexing seat 1650 may be retractable ball seats.

In embodiments, first indexing seat 1660 may initially have the same circumferences as the first ball seat because the hollow inner chamber may have the same circumference at the positioning of first indexing seat 1660 and the first ball seat. In other words, the hollow inner chamber at position 1665 may have the same circumference at a position of the first ball seat. However, the second indexing seat 1650 may initially have greater inner and outer circumferences than that of first indexing seat 1660 due to their being a recession 1655 within the outer sidewall.

Responsive to a frac ball being inserted into the frac sleeve, the frac ball may pass through the second indexing seat 1650 and be positioned on first indexing seat 1660. When pressure within the hollow chamber builds, the upper inner sleeve may linearly slide downward such that the first indexing seat 1660 is aligned with a second locking mechanism. This may cause second indexing seat 1660 to enlarge, allowing the frac ball to slide through the hollow chamber. Furthermore, when the upper inner sleeve moves linearly, second indexing seat 1650 may be aligned with projection 1670. Because the diameter within the hollow chamber across projection 1670 is smaller than that across recession 1655, the inner circumference and the outer circumference of second indexing seat 1650 may decrease.

Once all the sleeves in a cluster are activated, a subsequent frac ball of the same size may enter the hollow chamber and be positioned on the second indexing seat 1650. When pressure within the hollow chamber builds, the upper inner sleeve may linearly slide downward such that the second indexing seat 1650 is aligned with a third locking mechanism 1680. This may cause second indexing seat 1650 to enlarge, allowing the subsequent frac ball to slide through the hollow chamber.

This may allow the use of a frac ball of the same size to activate the upper and lower sleeves, while maintain the same upper ball seat size to subsequently drop the same size frac ball through the hollow chamber. Accordingly, a single size frac ball may be utilized per sleeve and/or per cluster of sleeves, which may increase the total number of sleeves that may be operated.

FIG. 17-20 depicts tables indicating stages comprised of a plurality of frac sleeves. Specifically, FIG. 17 depicts a table 1700 indicating stages 1710 comprised of a plurality of frac sleeves 1720. In embodiments, stage 1 may be the highest most stage in a completion tree and stage 3 may be the lowest most stage in a completion tree.

Each of the frac sleeves 1720 includes two sizing a frac balls 1730, 1740. A first, smaller frac ball 1730 may be configured to be positioned on a first ball seat, and a second larger frac ball 1740 may be configured to be positioned on a second ball seat.

As shown in table 1700, the smaller frac ball associated with a higher stage may correspond with the sizing of a larger frac ball associated with a lower stage. For example, a smaller frac ball associated with sleeve 5 may have a big sized diameter, whereas the larger frac ball associated with sleeve 6, at a lower stage, may correspond with the same big size diameter. This may allow smaller frac balls of higher stages to be passed down through stages to minimize the number of frac balls required.

As shown in FIG. 18, the smaller frac ball associated with a fracking port of a higher stage may be larger than the sizing of a larger frac ball for a production port associated with a lower stage.

As shown in FIG. 19, a smaller frac ball associated with a frac port may be the same throughout each stage and cluster. However, the sizing of a larger frac ball associated with a production port may decrease from stage to stage.

As shown in FIG. 20, frac balls associated with a highest most stage may be the same size for both the frac port and production port, wherein this size is larger than frac balls associated with lower stages.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A frac sleeve comprising:

a plurality of frac sleeves run in hole, each of the plurality of frac sleeves being configured to treat a different zone within the well and including;

an outer sidewall with an outer sidewall port, a first sleeve with a first active port, a second sleeve with a second active port, wherein the first active port moves in a first direction to be aligned with the second active port, and the second active port moves in a second direction to be aligned with the first active port, the first direction and second direction being opposite directions, wherein movement of the first sleeve to align the first active port and the outer sidewall port is independent from movement of the second sleeve, and the movement of the second sleeve is independent from the movement of the first sleeve, wherein the second sleeve remains static during the movement of the first sleeve to align the first active port and the outer sidewall port; and an object configured to form a seal within each of the plurality of frac sleeves, the object being configured to be acted on by fluid pressure to align the first active port and the second active port within each of the plurality of frac sleeves.

2. The frac sleeve of claim 1, wherein the first active port is configured to be misaligned with the outer sidewall port and the second active port before moving the first sleeve.

3. The frac sleeve of claim 2, wherein a passageway is formed through the first active port, second active port, and outer sidewall after moving the first sleeve in the first direction and the second sleeve in the second direction, the passageway extending from an inner diameter of the frac sleeve to an annulus positioned outside of the frac sleeve.

4. The frac sleeve of claim 2, wherein portions of the first sleeve are configured to overlap with portions of the second sleeve.

5. The frac sleeve of claim 1, wherein the first sleeve includes a first proximal end and a first distal end, and the second sleeve includes a second proximal end and a second distal end, wherein the first distal end is configured to be positioned between the second proximal end and the second distal end.

6. The frac sleeve of claim 5, further comprising:

a hydraulic vent having a variable size being positioned between the proximal end of the second sleeve and the proximal end of the first sleeve.

7. The frac sleeve of claim 1, wherein the outer sidewall port is a frac port.

8. The frac sleeve of claim 1, wherein the outer sidewall port is a production port.

9. The frac sleeve of claim 1, wherein the first sleeve and the second sleeve are configured to be locked in place when the first active port and the second active port are aligned.

10. A frac sleeve system comprising:

a plurality of frac sleeves run in hole, each of the frac sleeves being configured to treat a different zone within the well and including;

an outer sidewall with an outer sidewall port, a first sleeve with a first active port, a second sleeve with a second active port, wherein the first sleeve includes a first proximal end and a first distal end, and the second sleeve includes a second proximal end and a second distal end, wherein the first distal end is configured to be positioned between the second proximal end and the second distal end, wherein in a first position the first distal end is positioned above the second active port, and an object configured to form a seal within each of the plurality of frac sleeves, the object being configured to be acted on by fluid pressure to align the first active port and the second active port within each of the plurality of frac sleeves, wherein in a second position the first active port is aligned with the outer sidewall port and the second active port.

11. A method utilizing a frac sleeve system comprising:

running a plurality of frac sleeves in hole, each of the plurality of sleeves being configured to treat a different zone within the well and including a first sleeve and a second sleeve;

moving the first sleeve associated with a targeted sleeve of the plurality of sleeves with a first active port in a first direction;

moving the second sleeve associated with the targeted sleeve with a second active port in a second direction;

forming a seal, via an object, within each of the plurality of frac sleeves including the targeted sleeve;

aligning the first active port associated with the targeted sleeve and the second active port associated with the targeted sleeve based on fluid pressure being applied against the object forming the seal and moving the first sleeve associated with the targeted sleeve in the first direction and the second sleeve associated with the targeted sleeve in the second direction, wherein the first direction and the second direction are opposite directions, wherein movement of the first sleeve associated with the targeted sleeve to align the first active port and the outer sidewall port is independent from movement of the second sleeve associated with the targeted sleeve, and the movement of the second sleeve associated with the targeted sleeve is independent from the movement of the first sleeve associated with the targeted sleeve, wherein the second sleeve associated with the targeted sleeve remains static during the movement of the first sleeve associated with the targeted sleeve to align the first active port and the outer sidewall port.

12. The method of claim 11, wherein the first active port is misaligned with the outer sidewall port and the second active port before moving the first sleeve associated with the targeted sleeve.

13. The method of claim 12, further comprising:

forming a passageway through the first active port, second active port, and outer sidewall after moving the first sleeve associated with the targeted sleeve in the first direction and the second sleeve associated with the targeted sleeve in the second direction, the passageway extending from an inner diameter of the frac sleeve to an annulus positioned outside of the targeted frac sleeve.

14. The method of claim 12, wherein portions of the first sleeve associated with the targeted sleeve are configured to overlap with portions of the second sleeve associated with the targeted sleeve.

15. The method of claim 11, wherein the first sleeve associated with the targeted sleeve includes a first proximal end and a first distal end, and the second sleeve associated with the targeted sleeve includes a second proximal end and a second distal end, and positioning the first distal end between the second proximal end and the second distal end.

16. The method of claim 15, further comprising:

changing a size of a hydraulic vent, the hydraulic vent being positioned between the proximal end of the second sleeve associated with the targeted sleeve and the proximal end of the first sleeve associated with the targeted sleeve.

17. The method of claim 11, wherein the outer sidewall port is a frac port.

18. The method of claim 11, wherein the outer sidewall port is a production port.

19. The method of claim 11, further comprising:

locking the first sleeve associated with the targeted sleeve and the second sleeve associated with the targeted sleeve in place after aligning with the outer sidewall port, first active port, and the second active port.

* * * * *